United States Patent [19]

Fujimoto et al.

[11] Patent Number: 4,511,631

[45] Date of Patent: Apr. 16, 1985

[54] METALLIC CHROMIUM-NICKEL-HYDRATED CHROMIUM OXIDE-COATED TIN FREE STEEL AND PROCESS FOR THE PRODUCTION THEREOF

[75] Inventors: Terunori Fujimoto; Nobuyoshi Shimizu; Mutsuhiro Shimizu; Kazunori Yanagihara; Akio Miyachi; Tsuneo Inui, all of Yamaguchi, Japan

[73] Assignee: Toyo Kohan Co., Ltd., Tokyo, Japan

[21] Appl. No.: 599,822

[22] Filed: Apr. 13, 1984

[51] Int. Cl.[3] ..... C25D 5/12; C25D 5/48; C25D 11/38

[52] U.S. Cl. ..... 428/632; 204/35.1; 204/41; 428/667

[58] Field of Search ..... 204/41, 35.1; 428/632, 428/667; 427/405

[56] References Cited

U.S. PATENT DOCUMENTS

| | | | |
|---|---|---|---|
| 2,871,550 | 2/1959 | Weinberg et al. | 204/41 X |
| 3,009,236 | 11/1961 | Wesley et al. | 204/41 X |
| 3,669,851 | 6/1972 | Garvey | 204/41 X |
| 4,432,842 | 2/1984 | Inui et al. | 204/41 |

FOREIGN PATENT DOCUMENTS

| | | | |
|---|---|---|---|
| 18542 | 2/1980 | Japan | 204/41 |
| 48406 | 4/1980 | Japan | 204/41 |

*Primary Examiner*—G. L. Kaplan

*Attorney, Agent, or Firm*—Wenderoth, Lind & Ponack

[57] ABSTRACT

Tin free steel having three layers consisting of a bottom layer of metallic chromium, a middle layer of metallic nickel and a top layer of hydrated chromium oxide on a steel base, and a method for the continuous production of this tin free steel which comprises; (a) chromium plating a steel base to form a layer of metallic chromium and hydrated chromium oxide; (b) nickel plating the chromium plated steel base by using a nickel plating electrolyte sufficiently acidic to dissolve the hydrated chromium oxide and (c) forming a hydrated chromium oxide layer on the chromium plated nickel plated steel base.

Instead of step (b) in the above method, a cathodic treatment in an acidic solution can be carried out for the removal of the hydrated chromium oxide formed during chromium plating, and thereafter nickel plating can be carried out.

This tin free steel is useful for producing welded can bodies at high speed without removing the plated layer in the welded part, since it has an excellent weldability.

21 Claims, No Drawings

METALLIC CHROMIUM-NICKEL-HYDRATED CHROMIUM OXIDE-COATED TIN FREE STEEL AND PROCESS FOR THE PRODUCTION THEREOF

FIELD OF THE INVENTION

The present invention relates to a tin free steel having excellent weldability and excellent lacquer adhesion and method for its production. In detail, the invention relates to a tin free steel having three layers consisting of a bottom layer (layer closest to the steel base) of metallic chromium, a middle layer of metallic nickel and a top layer (layer farthest from the steel base) of hydrated chromium oxide on a steel base, and a method for production of this tin free steel which is characterized by nickel plating after chromium plating by using a nickel plating electrolyte having a pH of 0.5 to 2.0 or by nickel plating by using nickel plating electrolyte having a pH of 0.5 to 5.0 after a removal of a hydrated chromium oxide formed during chromium plating by using an acidic solution.

By using this tin free steel, a welded can body can be produced at high speed without removing the plated layer in the welded part.

BACKGROUND AND OBJECTIVE

Recently, the change from expensive electrotinplates to cheaper tin free steel (TFS-CT) having double layers consisting of a lower layer of metallic chromium and an upper layer of hydrated chromium oxide as well as a decrease in the weight of the tin coating in electrotinplates has rapidly taken place in the field of food cans.

This is because the tin used for the production of tinplate is very expensive and there is concern over the exhaustion of tin resources.

An ordinary metal can consists of two can ends and a single can body, except for drawn cans. In the case of tinplate, the seaming of the can body is generally carried out by soldering. In this soldering process, however, it is impossible to decrease the weight of the tin coating on the tinplate to under 2.8 g/m$^2$, because it is difficult to stabilize the soldering process when the weight of the tin coating is under 2.8 g/m$^2$. From the regulation of lead content in the solder used for the seaming of the tinplate can body in the field of food cans, the seaming of the tinplate can body is widely carried out by electric welding. A lap seam welding, for instance, the Soudronic process has been recently used for the seaming of the tinplate can body. In this process, it is desirable to decrease the tin coating weight in the tinplate, but the weldability of tinplate becomes poor with a decrease of the tin coating weight.

On the other hand, the seaming of a TFS-CT can body is generally carried out with nylon adhesives using Toyo Seam (trademark) and Mira Seam (trademark) methods. Another method of seaming a TFS-CT can body by electric welding is also well known.

In the case of the seaming of a TFS-CT can body by electric welding, however, the metallic chromium layer and the hydrated chromium oxide layer must be mechanically or chemically removed from the TFS-CT surface in order to easily weld the TFS-CT can body at high speed. Therefore, the corrosion resistance in the welded part of the TFS-CT can body becomes remarkably poor, even if this welded part is coated with lacquer after welding.

From the background described above, the development of a can material which is cheaper than tinplate, is easily welded at high speed without the removal of the plated layer and is excellent in corrosion resistance and lacquer adhesion, has been required in the field of food cans.

Recently, various surface treated steel sheets have been proposed as a can material which can be easily welded at high speed without the removal of the plated layer. For instance, the following surface treated steel sheets have been proposed: (a) Lightly tin coated steel sheet (LTS) with below about 1.0 g/m$^2$ of tin which is reflowed or unreflowed after tin plating (Japanese Patent Publication Nos. Sho 56-3440, Sho 56-54070, Sho 57-55800, and Laid-Open Japanese Patent Application Nos. Sho 56-75589, Sho 56-130487, Sho 56-156788, Sho 57-101694, Sho 57-185997, Sho 57-192294, Sho 57-192295 and Sho 55-69297). (b) Nickel preplated LTS with below about 1.0 g/m$^2$ of tin (Laid-Open Japanese Patent Application Nos. Sho 57-23091, Sho 57-67196, Sho 57-110685 Sho 57-177991, Sho 57-200592 and Sho 57-203797). (c) Nickel plated steel sheet with chromate film or phosphate film (Laid-Open Japanese Patent Application Nos. Sho 56-116885, Sho 56-169788, Sho 57-2892, Sho 57-2985, Sho 57-2896, Sho 57-2897, Sho 57-35697 and Sho 57-35698). (d) TFS-CT having double layers consisting of a lower layer of metallic chromium and an upper layer of hydrated chromium oxide which is obtained by some special methods such as cold rolling after TFS treatment (Laid-Open Japanese Patent Application No. Sho 55-48406), porous chromium plating (Laid Open Japanese Patent Application No. Sho 55-31124) and a cathodic treatment of a steel sheet in chromic acid electrolyte with fluoride but without anions such as sulfate, nitrate and chloride ion (Laid-Open Japanese Patent Application No. Sho 55-18542).

However, LTS and nickel preplated LTS above-identified as (a) and (b) are slightly more expensive than TFS-CT. Furthermore, these have not only a narrower current range for sound welding than that in tinplate, but also poor lacquer adhesion compared with that in TFS-CT, although these can be welded without the removal of the plated layer. The reason why the current range for sound welding in LTS and nickel preplated LTS is narrower than in tinplate is considered to be that the amount of free tin in these is smaller than that in tinplate and also further decreases because of changes of free tin to iron-tin alloy or nickel-tin alloy by heating for lacquer curing. Nickel plated steel sheet with chromate film or phosphate film identified above as (c) is also slightly more expensive than TFS-CT. The current range for sound welding of nickel plated steel sheet is narrower than that in LTS or nickel preplated LTS. Furthermore, the corrosion resistance of nickel plated steel sheet is poorer than that in TFS-CT, although the lacquer adhesion of nickel plated steel sheet is good. Particularly, pitting corrosion in the defective part of the lacquered nickel plated steel sheet may occur easily from acidic foods such as tomato juice because the potential of nickel is more noble than that of steel base and metallic chromium. It is considered that the welding of TFS-CT shown in (d) without the removal of TFS-CT film at high speed is very difficult because the oxide films having high electric resistance are formed by the oxidation of metallic chromium and exposed steel base and by the dehydration of hydrated chromium oxide during heating for curing the lacquer coating on the TFS-CT can body, although TFS-CT shown in (d) may be welded when it is not heated before welding.

As described above, various surface treated steel sheets proposed in (a), (b), (c) and (d) have various problems in the production cost and the characteristics as a can material which can be easily welded without the removal of the plated layer at high speed.

Accordingly, it is the first objective of the present invention to provide a tin free steel having an excellent weldability, that is, easily being welded without the removal of the plated layer at high speed, and having excellent characteristics in lacquer adhesion and corrosion resistance after lacquering such as that in TFS-CT.

It is the second objective of the present invention to provide a method for the continuous production of a tin free steel having an excellent weldability at high speed.

BRIEF DESCRIPTION OF THE INVENTION

The first objective of the present invention can be accomplished by providing a tin free steel (TFS-CNT) having three layers consisting of a bottom layer of metallic chromium, a middle layer of metallic nickel and a top layer of hydrated chromium oxide on a steel base.

The second objective of the present invention can be accomplished by a nickel plating on the chromium plated steel base after the removal of hydrated chromium oxide formed during chromium plating. More specifically, the method of the present invention is characterized by a nickel plating onto the chromium plated steel base wherein nickel plating is carried out with the removal of hydrated chromium oxide formed during chromium plating by using a nickel plating electrolyte having a low pH such as 0.5 to 2.0. Another method of the present invention is characterized by a nickel plating onto the chromium plated steel base by using a nickel plating electrolyte having a pH of 0.5 to 5.0 after the removal of hydrated chromium oxide formed during chromium plating by a cathodic treatment in an acidic solution, a pH of 0.5 to 2.0.

The TFS-CNT according to the present invention can be used in applications wherein excellent weldability, i.e. easily being welded without the removal of the plated layer at high speed, is required, such as food can bodies, aerosol can bodies and miscellaneous can bodies which are lacquered but for the welded part before welding.

The TFS-CNT can be also used in applications wherein the lacquer coating is not carried out because it has an excellent weldability. Furthermore TFS-CNT according to the present invention can be used in applications wherein excellent lacquer adhesion and excellent corrosion resistance after lacquering are required, such as can ends, drawn cans and drawn and redrawn cans (DR cans), besides can bodies.

DETAILED DESCRIPTION OF THE INVENTION

The steel base used for the production of the TFS-CNT according to the present invention can be any cold rolled steel sheet customarily used in manufacturing electrotinplate and TFS-CT. Preferably, a type of steel base for electrotinplate, as set out in ASTM A 623-76 of 1977 (standard specification for general requirements for tin mill product), is employed as the steel base. Preferably, the thickness of the steel base is from about 0.1 to about 0.35 mm.

The TFS-CNT according to the present invention is produced by the following processes: (1) degreasing with an alkali and pickling with an acid→water rinsing→chromium plating→water rinsing→nickel plating with the removal of hydrated chromium oxide→water rinsing→chromate treatment→water rinsing→drying or (2) degreasing with an alkali and pickling with an acid→water rinsing→chromium plating→water rinsing→the removal of hydrated chromium oxide by a cathodic treatment in an acid solution→water rinsing nickel plating→water rinsing→chromate treatment→water rinsing→drying.

At first, in order to form a metallic chromium layer as a bottom layer of the TFS-CNT according to the present invention, a known chromium plating electrolyte such as a Sargent bath or a chromic acid electrolyte containing additives such as fluorine compounds and sulfur compounds, which are used for the production of TFS-CT having a lower layer of metallic chromium and an upper layer of hydrated chromium oxide, may be employed.

In the present invention, it is preferable to employ the following electrolytic chromium plating conditions for the formation of a metallic chromium layer on a steel base:

Concentration of chromic acid: 30–300 g/l, more preferably 80–300 g/l.

Concentration of additives: 1.0–5.0 weight % more preferably 1.0–3.0 weight % of the concentration of chromic acid.

Additives: at least one compound selected from the group consisting of fluorine compounds and sulfur compounds.

Temperature of the electrolyte: 30°–60° C.

Cathodic current density: 10–100 A/dm$^2$

Generally, the amount of hydrated chromium oxide formed during chromium plating decreases with an increase in the concentration of chromic acid in the suitable weight ratio of additives to chromic acid. It is not preferable to use an electrolyte having below 30 g/l of chromic acid for the chromium plating, because the current efficiency for the deposition of metallic chromium decreases remarkably. The concentration of chromic acid above 300 g/l is not also suitable from an economical point of view.

The presence of additives such as fluorine compounds and sulfur compounds in the chromium plating electrolyte is indispensable for a uniform chromium deposition. If the weight % of additives to chromic acid is below 1.0 or above 5.0, the current efficiency for the deposition of metallic chromium remarkably decreases, in addition to a decrease in the uniformity of the deposited metallic chromium layer. Particularly, at below a 1.0 value for the weight % of additives to chromic acid, the formed insoluble hydrated chromium oxide remarkably prevents the formation of an uniform metallic nickel layer in the following nickel plating. It is preferable that the additives be at least one compound selected from the group consisting of fluorine compounds, such as hydrofluoric acid, fluoboric acid, fluosilicic acid, ammonium bifluoride, an alkali metal bifluoride, ammonium fluoride, an alkali metal fluoride, ammonium fluoborate, an alkali metal fluoborate, ammonium fluosilicate, an alkali metal fluosilicate, aluminum fluoride and sulfur compounds such as sulfuric acid, ammonium sulfate, an alkali metal sulfate, chromium sulfate, phenolsulfonic acid, ammonium phenolsulfonate, an alkali metal phenolsulfonate, phenoldisulfonic acid, ammonium phenoldisulfonate, an alkali metal phenoldisulfonate, ammonium sulfite, an alkali metal sulfite, ammonium thiosulfate.

The amount of hydrated chromium oxide formed during chromium plating decreses with an increase in the temperature of the electrolyte. The temperature of the electrolyte above 60° C. is not suitable from an industrial point of view, because the current efficiency for the deposition of metallic chromium decreases remarkably. The temperature of the electrolyte below 30° C. is not also suitable because a long time is necessary for the removal of the large amount of hydrated chromium oxide formed during chromium plating.

With an increase in cathodic density, the current efficiency for the deposition of metallic chromium increases and the amount of hydrated chromium oxide formed during chromium plating decreases. It is suitable in the present invention that the range of the cathodic current density for the deposition of metallic chromium be 10 to 100 A/dm$^2$, more preferably 40 to 80 A/dm$^2$, because metallic chromium almost does not deposit at below 10 A/dm$^2$ of the current density and the current efficiency for the deposition of metallic chromium almost does not increase at above 100 A/dm$^2$ of current density.

In the present invention, the conditions for chromium plating wherein a good current efficiency for the deposition of metallic chromium is obtained and a small amount of hydrated chromium oxide is formed, should be selected because the presence of hydrated chromium oxide prevents the formation of a uniform nickel layer in the following nickel plating.

However, hydrated chromium oxide is always formed on a deposited metallic chromium layer during chromium plating. Under the conditions of higher concentration of chromic acid, higher current density and higher temperature of the electrolyte, the amount of hydrated chromium oxide formed on the deposited metallic chromium is about 3 to 10 mg/m$^2$ as chromium. On the contrary, under the conditions of lower concentration of chromic acid, lower current density and lower temperature of the electrolyte, it is about 10 to 50 mg/m$^2$ as chromium.

When a large amount of hydrated chromium oxide is formed during chromium plating, it is possible to decrease it by leaving the chromium plated steel base in the chromium plating electrolyte for a few seconds. However, hydrated chromium oxide of about 3 to 5 mg/m$^2$ as chromium remains on the surface of the chromium plated steel base, even if the chromium plated steel base covered with hydrated chromium oxide is left in the chromium plating electrolyte for a long time.

In the present invention, these hydrated chromium oxides must be removed before the following nickel plating because the presence of hydrated chromium oxide prevents the deposition of an uniform nickel layer on a metallic chromium layer.

The following methods have been considered for the removal of the hydrated chromium oxide on the deposited metallic chromium layer.

(A) An immersion of the chromium plated steel base before drying into a high concentration of an alkaline solution such as an alkali metal hydroxide and an alkali metal carbonate at high temperature of 70° to 90° C. It is difficult to industrialize this method, because the alkaline solution may be mixed into the following nickel plating electrolyte.

(B) An immersion of the chromium plated steel base before drying into an acid solution such as sulfuric acid and hydrochloric acid. This method is not suitable in the present invention, because the hydrated chromium oxide formed during chromium plating is not sufficiently dissolved by immersion into an acid solution for a short time.

(C) A mechanical removal of hydrated chromium oxide by a brushing roll or wiper in an alkaline solution and an acid solution before drying of the chromium plated steel base. The hydrated chromium oxide formed on the deposited metallic chromium layer is not uniformly removed by this method.

Therefore these methods such as (A), (B) and (C) are not suitable for the removal of hydrated chromium oxide before the following nickel plating.

In the present invention, the following methods are preferable for the removal of hydrated chromium oxide formed on the metallic chromium layer. One is the method wherein the chromium plated steel base is cathodically treated in an acid solution such as sulfuric acid and hydrochloric acid having a pH of 0.5 to 2.0, before the following nickel plating. The other is the method wherein nickel plating is carried out at the same time with the removal of hydrated chromium oxide formed on the metallic chromium layer by using a nickel plating electrolyte having a pH of 0.5 to 2.0.

The conditions for the removal of hydrated chromium oxide by the former method are as follows:

Solution: An acid solution containing at least one acid selected from the group consisting of sulfuric acid, hydrochloric acid, fluoboric acid, fluosilicic acid and hydrofluoric acid having a pH of 0.5 to 2.0

Temperature of the solution: 30°–70° C.

Cathodic current density: 2–50 A/dm$^2$

Treating time: 0.5–5.0 seconds

Although the main component in the solution is sulfuric acid and/or hydrochloric acid, if the pH of the solution is kept between 0.5 to 2.0, various ions which are not deposited on the surface of the chromium plated steel base or do not oxidize the surface of the chromium plated steel base, can be contained in the solution. It is not necessary that the temperature of the solution be strictly controlled if it is kept between 30° to 70° C. If the temperature of the solution is above 70° C., the evaporation of water is increased. At below 30° C. a cathodic treatment for a long time is required for a sufficient removal of hydrated chromium oxide.

At below 2 A/dm$^2$ of current density, hydrated chromium oxide is not sufficiently removed, even if the chromium plated steel base is cathodically treated for a long time. An upper limit of current density is limited to 50 A/dm$^2$ because the affect of the present treatment is not increased in a current density above 50 A/dm$^2$.

If the treating time is below 0.5 seconds, hydrated chromium oxide is not sufficiently removed from the metallic chromium layer, even if the higher current density is applied. The treating time above 5.0 seconds is not suitable in the high speed production of TFS-CNT.

The conditions for the latter method wherein nickel plating is carried out at the same time with the removal of hydrated chromium oxide formed on the metallic chromium layer is as follows:

Concentration of nickel ion: 5–80 g/l pH of the electrolyte: 0.5–2.0, more preferably 0.5–1.5

Temperature of the electrolyte: 30°–70° C., more preferably 30°–50° C.

Cathodic current density: 2–50 A/dm$^2$, more preferably 2–30 A/dm$^2$.

The concentration of nickel ion below 5 g/l is not suitable in the present invention, because the current efficiency for the deposition of nickel decreases remarkably and becomes unstable by the presence of a small amount of ions such as chromium ion and iron which are built up into the electrolyte by a dissolution of hydrated chromium oxide and a steel base. The concentration of nickel ion is limited to 80 g/l from the standpoint of resource conservation, although the affect of the present plating is not decreased at a concentration above 80 g/l.

Nickel ion is mainly supplied by the addition of nickel sulfate, nickel chloride and nickel sulfamate or the dissolution of a soluble nickel anode.

The pH of the electrolyte is very important for nickel plating on the chromium plated steel base with the removal of hydrated chromium oxide formed on the metallic chromium layer in the present invention. The pH range of the electrolyte should be from 0.5 to 2.0, preferably 0.5 to 1.5.

Nickel plating is industrially carried out by using a nickel plating electrolyte having a pH of 3 to 5.5 such as a Watts bath containing nickel sulfate, nickel chloride and boric acid or nickel sulfamate bath. If the pH of the electrolyte is below 3, the current efficiency for the deposition of nickel decreases with an increase in the evolution of hydrogen. At above pH 5.5, hydroxide precipitates and nickel does not deposit. Therefore the known nickel plating electrolyte is not desirable for nickel plating with the removal of hydrated chromium oxide in the present invention, although it is used for nickel plating after the removal of hydrated chromium oxide by a cathodic treatment in an acid solution such as sulfuric acid and hydrochloric acid described above.

At a low pH such as 0.5 to 2.0, the surface of the chromium plated steel base is uniformly activated because hydrated chromium oxide formed during chromium plating is easily removed from the chromium plated steel base by the evolution of a large amount of hydrogen and the dissolving action by acid. Therefore a uniform metalic nickel layer is formed on the metallic chromium layer. A pH of below 0.5 is not desirable in the present invention, because a part of metallic chromium may be dissolved. And the pH of above 2.0 is also not desirable in high speed production of TFS-CNT according to the present invention, because the uniform metallic nickel layer is not formed on the metallic chromium layer by the insufficient dissolution of hydrated chromium oxide for a short time. Furthermore, it is difficult to produce TFS-CNT stably because the pH of the electrolyte changes considerably by a slight change in the concentration of nickel ion and acid.

The pH of the electrolyte is mainly controlled by the addition of sulfuric acid, hydrochloric acid, fluoboric acid, fluosilicic acid and hydrofluoric acid. Various ions, which do not give bad effects for nickel plating and the dissolution of hydrated chromium oxide, may be contained in the electrolyte if the pH of the electrolyte is kept in the range of from 0.5 to 2.0.

It is suitable in the present invention that the range of the cathodic current density is 2 to 50 A/dm$^2$, more preferably 2 to 30 A/dm$^2$. If the current density is below 2 A/dm$^2$, the current efficiency for nickel plating by this electrolyte becomes so low that a long time is necessary for the deposition of the required amount of nickel. If the current density is above 50 A/dm$^2$, it is difficult to deposit metallic nickel because of the formation of nickel hydroxide.

The optimum range for the temperature of the electrolyte is from 30° to 70° C., more preferably 30° to 50° C. At below 30° C., hydrated chromium oxide is not dissolved sufficiently, so that the uniform nickel layer is not plated on the metallic chromium plated steel base. At above 70° C., a part of metallic chromium is dissolved along with hydrated chromium oxide.

Both methods described above are also applied for the removal of hydrated chromium oxide in the case of drying after chromium plating and water rinsing. In these cases, the removal of hydrated chromium oxide and nickel plating with the removal of hydrated chromium oxide are carried out under the same conditions described above.

In the case of nickel plating after the removal of hydrated chromium oxide by a cathodic treatment in an acid solution described above, a known nickel plating electrolyte such as Watts bath or nickel sulfamate bath is also used in the present application.

Therefore, the following conditions for nickel plating is used in this case:

Concentration of nickel ion: 5–80 g/l
pH of the electrolyte: 0.5–5.5
Temperature of the electrolyte: 30°–70° C.
Cathodic current density: 2–50 A/dm$^2$ In the present invention, the range of the amount of metallic nickel deposited on the chromium plated steel base is very important in order to obtain an excellent weldability, in addition to the conditions for the removal of hydrated chromium oxide and the conditions for nickel plating.

It is considered that the role of metallic nickel in the excellent weldability in TFS-CNT according to the present invention is as follows:

(1) Metallic nickel layer prevents the formation of chromium oxide having high electric resistance by the oxidation of metallic chromium during heating for lacquer curing.

(2) Metallic nickel layer prevents the formation of iron oxide having high electric resistance by the oxidation of steel base exposed through the pores of chromium layer during heating for lacquer curing because the exposed area of steel base through the pores of chromium layer decreases by the deposition of metallic nickel on metallic chromium layer and steel base.

The optimum range for the amount of metallic nickel deposited on the chromium plated steel base is from 5 to 100 mg/m$^2$, more preferably 15 to 50 mg/m$^2$. If the amount of metallic nickel deposited on the metallic chromium layer is below 5 mg/m$^2$, the excellent weldability, which is an objective of the present invention, is not obtained, because the metallic chromium layer and exposed steel base are not sufficiently covered with the deposited nickel. The amount of the plated nickel is limited to 100 mg/m$^2$ from high speed production of TFS-CNT according to the present invention, although the affect of nickel in the present invention is not decreased in an amount above 100 mg/m$^2$.

In the present invention, the presence of metallic chromium of 30 to 300 mg/m$^2$ as the bottom layer in TFS-CNT is indispensable in order to obtain the excellent weldability. If the amount of metallic chromium is below 30 mg/m$^2$, the excellent weldability of TFS-CNT is not obtained because the surface of a steel base is not sufficiently covered with the deposited metallic chromium and metallic nickel, even if above 100 mg/m$^2$ of metallic nickel is plated on the chromium plated steel base. Furthermore, the corrosion resistance becomes poor compared with that of TFS-CT. The amount of metallic chromium is limited to 300 mg/m$^2$ from an economical and an industrial point of view. At above 300 mg/m$^2$ of metallic chromium, many cracks may occur in the metallic chromium layer by forming of TFS-CNT into a body and end of can according to the present invention.

It is considered that there is the following difference between nickel plating by a known elelctrolyte such as Watts bath or nickel sulfamate bath and chromium plating by a known electrolyte on a steel base.

In nickel plating, iron oxide which is present on the surface of the steel base is not sufficiently removed because the electrolyte has high pH (3–5.5) compared with that in chromium plating electrolyte and a greater part of the electricity is consumed for the deposition of nickel.

On the contrary, in chromium plating, iron oxide is sufficiently removed by its dissolution into the electrolyte and the cathodic reduction thereof, because the electrolyte has low pH (below about 1.0) and about below 20% of the electricity is consumed for the deposition of chromium.

Therefore, in the case of direct plating of nickel on a steel base, many pores which expose the steel base are present in the resultant nickel plated steel base, although the steel base is sufficiently covered with the plated chromium in the case of direct plating of chromium on the steel base.

The weldability of nickel plated steel sheet becomes remarkably poor because iron oxide, having high electric resistance, is formed by the oxidation of the exposed steel base during heating for lacquer curing. The weldability of chromium plated steel sheet becomes poor, because the plated metallic chromium is oxidized with the oxidation of the exposed steel base during heating for lacquer occurring.

For the reason described above, the presence of metallic chromium as a bottom layer and metallic nickel as a middle layer in TFS-CNT according to the present invention are indispensable in order to obtain the excellent weldability after heating.

Furthermore, in the present invention, the presence of a small amount of hydrated chromium oxide as a top layer in TFS-CNT is also indispensable in order to prevent the oxidation of the exposed steel base and the exposed metallic chromium after nickel plating during heating for lacquer curing and to obtain the excellent lacquer adhesion and the excellent corrosion resistance after forming.

The optimum range of hydrated chromium oxide is from 2 to 18 mg/m$^2$, more preferably 4 to 12 mg/m$^2$ as chromium.

If the amount of hydrated chromium oxide is below 2 mg/m$^2$ as chromium, the lacquer adhesion and the corrosion resistance after forming become poor.

If the amount of hydrated chromium oxide is above 18 mg/m$^2$, the weldability becomes remarkably poor, because hydrated chromium oxide changes to chromium oxide having high electric resistance by the dehydration of it during heating for lacquer curing.

For the formation of the hydrated chromium oxide top layer of the TFS-CNT according to the present invention, a known electrolyte such as the acidic chromate electrolyte used for the post-treatment of electrotinplate or a chromic acid electrolyte containing a small amount of additives such as fluorine compounds and sulfur compounds, which are used for the production of TFS-CT having a lower layer of metallic chromium and an upper layer of hydrated chromium oxide, may be employed.

In the present invention, two types of electrolytes are used for the formation of hydrated chromium oxide. The first type of electrolyte consists of an acidic chromate electrolyte without addition of additives such as fluorine compounds and sulfur compounds. The second type of electrolyte consists of chromic acid electrolyte with additives such as fluorine compounds and sulfur compounds.

It is suitable to employ the following conditions for the formation of hydrated chromium oxide of 2 to 18 mg/m$^2$ as chromium by using the first type of the electrolyte:

Concentration of hexavalent chromium ion: 5–30 g/l
Temperature of the electrolyte: 30°–70° C.
Cathodic current density; 1–20 A/dm$^2$
Quantity of electricity: 1–40 coulombs/dm$^2$.

If the concentration of hexavalent chromium ion is below 5 g/l, waste of electric power results because of the higher electric resistance of the electrolyte. The concentration of hexavalent chromium ion is limited to 30 g/l from the viewpoint of conserving resources, although the affect of the present treatment is not decreased in a concentration above 30 g/l.

It is an essential condition that the electrolyte be acidified. In the case of an alkaline electrolyte, the efficiency for the formation of hydrated chromium oxide is so low that a long time is necessary for the formation of satisfactory hydrated chromium oxide. Therefore, the electrolyte containing only a chromate of an alkali metal or ammonium is not used in the present invention.

In above case it should be acidified by the addition of chromic acid. It is also possible to add a hydroxide of an alkali metal or ammonium to chromic acid electrolyte within an acid range.

Therefore, at least one chromate selected from the group consisting of chromic acid, a chromate and dichromate of an alkali metal, ammonium chromate and ammonium dichromate is used for the first type of the electrolyte within an acid range in the present invention. It is not necessary that the temperature of the electrolyte is strictly controlled if it is kept between 30° to 70° C.

If the temperature of the electrolyte be above 70° C., the evaporation of water is increased.

Under a current density below 1 A/dm$^2$, a long time is necessary for the formation of a satisfactory hydrated chromium oxide. Under a current density above 20 A/dm$^2$, the control in the amount of the formed hydrated chromium oxide may be difficult, although a satisfactory hydrated chromium oxide is formed by a cathodic treatment for a short time.

If the quantity of electricity is below 1 coulomb/dm$^2$, it is difficult to form a suitable amount of hydrated chromium oxide. At above 40 coulombs/dm$^2$ the weldability of TFS-CNT becomes poor because of the formation of thicker hydrated chromium oxide.

it is desirable to employ the following conditions for the formation of hydrated chromium oxide by using the second type of the electrolyte:

Concentration of chromic acid: 10–50 g/l
Concentration of additives to chromic acid: 0.2–1.0 weight %

Additives: Sulfur compound and/or fluorine compound

Temperature of the electrolyte: 30°–60° C.

Cathodic current density: 1–10 A/dm$^2$.

In the conditions described above, weight % of additives to chromic acid and current density are very important in the present treatment, because at a higher weight % of additives to chromic acid and higher current density, metallic chromium, which gives a bad affect to the weldability of TFS-CNT, is deposited on the nickel plated steel base. Therefore the weight % of additives to chromic acid is limited to 1.0 and a cathodic current density is limited to 10 A/dm$^2$. However, if the weight % of additives to chromic acid is below 0.2, the weldability becomes poor because thick hydrated chromium oxide is formed. Under a current density below 1 A/dm$^2$, a long time is necessary for the formation of a satisfactory hydrated chromium oxide. Furthermore, the range in the concentration of chromic acid, the quantity of electricity and the temperature of the electrolyte are limited as in the first type of the electrolyte by the same reason.

Additives are also selected from the same group as in chromium plating electrolytes.

In the treatment using the second type of the electrolyte, it is very important to select the conditions wherein metallic chromium is not deposited in the nickel plated surface. However, under some conditions wherein metallic chromium is deposited, the maximum amount of metallic chromium deposited on the nickel plated surface should be limited to 10 mg/m$^2$, although the amount of the deposited metallic chromium should be ideally zero.

The present invention is illustrated by the following Examples.

In Example 1 to Example 3, a cold rolled steel sheet having a thickness of 0.22 mm was treated by the following process after electrolytically degreasing in a solution of 70 g/l of sodium hydroxide, water rinsing and then pickling in a solution of 100 g/l of sulfuric acid.

Chromium plating→water rinsing→nickel plating with the removal of hydrated chromium oxide formed during chromium plating→water rinsing→chromate treatment→water rinsing→drying.

In Example 4 to Example 6, the same kind of steel sheet pretreated as in Example 1 to Example 3 was treated by the following process.

Chromium plating→water rinsing→the removal of hydrated chromium oxide formed during chromium plating by a cathodic treatment in an acidic solution→water rinsing→nickel plating→water rinsing→chromate treatment→water rinsing→drying.

In each Example, the conditions are shown in detail.

EXAMPLE 1

| | |
|---|---|
| Conditions for chromium plating | |
| Composition of electrolyte | |
| $CrO_3$ | 100 g/l |
| NaF | 5 g/l |
| Temperature of electrolyte | 50° C. |
| Cathodic current density | 20 A/dm$^2$ |
| Conditions for nickel plating with the removal of hydrated chromium oxide | |
| Composition of electrolyte | |
| $NiSO_4.6H_2O$ | 240 g/l |
| $NiCl_2.6H_2O$ | 30 g/l |
| $H_3BO_3$ | 30 g/l |

-continued

| | |
|---|---|
| pH (by addition of $H_2SO_4$) | 0.5 |
| Temperature of electrolyte | 40° C. |
| Cathodic current density | 5 A/dm$^2$ |
| Condition for chromate treatment | |
| Composition of electrolyte | |
| $Na_2Cr_2O_7.2H_2O$ | 30 g/l |
| Temperature of electrolyte | 40° C. |
| Cathodic current density | 5 A/dm$^2$ |
| Quantity of electricity | 15 coulombs/dm$^2$ |

EXAMPLE 2

| | |
|---|---|
| Condition for chromium plating | |
| Composition of electrolyte | |
| $CrO_3$ | 30 g/l |
| $H_2SO_4$ | 1 g/l |
| Temperature of electrolyte | 60° C. |
| Cathodic current density | 20 A/dm$^2$ |
| Conditions for nickel plating with the removal of hydrated chromium oxide | |
| Composition of electrolyte | |
| $Ni(NH_2SO_3)_2.4H_4O$ | 380 g/l |
| $H_3BO_3$ | 30 g/l |
| pH (by addition of HCl) | 1.2 |
| Temperature of electrolyte | 60° C. |
| Cathodic current density | 30 A/dm$^2$ |
| Conditions for chromate treatment | |
| Composition of electrolyte | |
| $CrO_3$ | 30 g/l |
| $Na_2SiF_6$ | 0.3 g/l |
| Temperature of electrolyte | 55° C. |
| Cathodic current density | 10 A/dm$^2$ |
| Quantity of electricity | 20 coulombs/dm$^2$ |

EXAMPLE 3

| | |
|---|---|
| Conditions for chromium plating | |
| Composition of electrolyte | |
| $CrO_3$ | 100 g/l |
| HF | 3 g/l |
| Temperature of electrolyte | 60° C. |
| Cathodic current density | 100 A/dm$^2$ |
| Conditions for nickel plating with the removal of hydrated chromium oxide | |
| Composition of electrolyte | |
| $NiSO_4.6H_2O$ | 20 g/l |
| pH (by addition of $H_2SO_4$) | 2.0 |
| Temperature of electrolyte | 30° C. |
| Cathodic current density | 2 A/dm$^2$ |
| Condition for chromate treatment | |
| Composition of electrolyte | |
| $K_2Cr_2O_7$ | 80 g/l |
| Temperature of electrolyte | 30° C. |
| Cathodic current density | 10 A/dm$^2$ |
| Quantity of electricity | 40 coulombs/dm$^2$ |

EXAMPLE 4

| | |
|---|---|
| Condition for chromium plating | |
| Composition of electrolyte | |
| $CrO_3$ | 120 g/l |
| $HBF_4$ | 0.8 g/l |
| $H_2SO_4$ | 0.5 g/l |
| Temperature of electrolyte | 60° C. |
| Cathodic current density | 60 A/dm$^2$ |
| Conditions for the removal of hydrated chromium oxide | |
| Composition of electrolyte | |
| $H_2SO_4$ | pH 0.5 |
| Temperature of electrolyte | 30° C. |
| Cathodic current density | 10 A/dm$^2$ |

-continued

| | |
|---|---|
| Treating time | 5 seconds |
| Conditions for nickel plating | |
| Composition of electrolyte | |
| $Ni(NH_2SO_3)_2.4H_2O$ | 250 g/l |
| pH (by addition of HCl) | 0.5 |
| Temperature of electrolyte | 40° C. |
| Cathodic current density | 50 A/dm$^2$ |
| Conditions for chromate treatment | |
| Composition of electrolyte | |
| $Na_2Cr_2O_7.2H_2O$ | 80 g/l |
| Temperature of electrolyte | 40° C. |
| Cathodic current density | 10 A/dm$^2$ |
| Quantity of electricity | 10 coulombs/dm$^2$ |

EXAMPLE 5

| | |
|---|---|
| Conditions for chromium plating | |
| Composition of electrolyte | |
| $CrO_3$ | 200 g/l |
| NaF | 6 g/l |
| $Na_2SiF_6$ | 1 g/l |
| Temperature of electrolyte | 50° C. |
| Cathodic current density | 40 A/dm$^2$ |
| Conditions for the removal of hydrated chromium oxide | |
| Composition of electrolyte | |
| HCl | pH 1.2 |
| Temperature of electrolyte | 40° C. |
| Cathodic current density | 50 A/dm$^2$ |
| Treating time | 0.5 seconds |
| Conditions for nickel plating | |
| Compositon of electrolyte | |
| $NiSO_4.6H_2O$ | 250 g/l |
| $NiCl_2.6H_2O$ | 50 g/l |
| $H_3BO_3$ | 20 g/l |
| pH (by addition of $H_2SO_4$) | 3.8 |
| Temperature of electrolyte | 70° C. |
| Cathodic current density | 2 A/dm$^2$ |
| Conditions for chromate treatment | |
| Composition of electrolyte | |
| $K_2Cr_2O_7$ | 15 g/l |
| Temperature of electrolyte | 70° C. |
| Cathodic current density | 1.5 A/dm$^2$ |
| Quantity of electricity | 1.5 coulombs dm$^2$ |

EXAMPLE 6

| | |
|---|---|
| Conditions for chromium plating | |
| Composition of electrolyte | |
| $CrO_3$ | 300 g/l |
| $H_2SO_4$ | 3 g/l |
| Temperature of electrolyte | 30° C. |
| Cathodic current density | 10 A/dm$^2$ |
| Conditions for the removal of hydrated chromium oxide | |
| Composition of electrolyte | |
| HF | pH 2.0 |
| Temperature of electrolyte | 60° C. |
| Cathodic current density | 2 A/dm$^2$ |
| Treating time | 1 second |
| Condition for nickel plating | |
| Composition of electrolyte | |
| $NiSO_4.6H_2O$ | 240 g/l |
| $NiCl_2.6H_2O$ | 30 g/l |
| $H_3BO_3$ | 30 g/l |
| pH (no addition of acid) | 5.5 |
| Temperature of electrolyte | 40° C. |
| Cathodic current density | 2 A/dm$^2$ |
| Conditions for chromate treatment | |
| Composition of electrolyte | |
| $CrO_3$ | 50 g/l |
| $H_2SO_4$ | 0.1 g/l |
| Temperature of electrolyte | 30° C. |
| Cathodic current density | 3 A/dm$^2$ |

-continued

| | |
|---|---|
| Quantity of electricity | 6 coulombs/dm$^2$ |

Comparative Example 1

The same kind of steel sheet pretreated as in Example 1 was treated under the following conditions and was then rinsed with water and dried.

| Conditons of electrolytic chromic acid treatment | |
|---|---|
| Composition of electrolyte | |
| $CrO_3$ | 80 g/l |
| $HBF_4$ | 0.5 g/l |
| $H_2SO_4$ | 0.5 g/l |
| Temperature of electrolyte | 45° C. |
| Cathodic current density | 20 A/dm$^2$ |

Comparative Example 2

The same kind of steel sheet pretreated as in Example 1 was plated with nickel under the following conditions.

| Conditions for nickel plating | |
|---|---|
| Composition of electrolyte | |
| $NiSO_4.6H_2O$ | 240 g/l |
| $NiCl_2.6H_2O$ | 30 g/l |
| $H_3BO_3$ | 30 g/l |
| pH (no addition of acid) | 5.5 |
| Temperature of electrolyte | 40° C. |
| Cathodic current density | 5 A/dm$^2$ |

After rinsing with water, the nickel plated steel sheet was treated under the following conditions and was then rinsed with water and dried.

| Conditions for chromate treatment | |
|---|---|
| Composition of electrolyte | 50 g/l |
| $Na_2Cr_2O_7.2H_2O$ | |
| Temperature of electrolyte | 40° C. |
| Cathodic current density | 3 A/dm$^2$ |
| Quantity of electricity | 15 coulombs/dm$^2$ |

Comparative Example 3

The same kind of steel sheet pretreated as in Example 1 was plated with chromium by using an aqueous electrolyte containing 100 g/l of $CrO_3$ and 5 g/l of NaF under a current density of 20 A/dm$^2$ at a temperature of 50° C. After rinsing with water, the chromium plated steel sheet with hydrated chromium oxide of about 3 mg/m$^2$ as chromium was plated with nickel under the same conditions as in Comparative example 2.

After rinsing with water, the chromium and nickel plated steel sheet was treated by using 30 g/l of $Na_2Cr_2O_7.2H_2O$ under the same conditions as in Comparative example 2 and was then rinsed with water and dried.

The weldability, lacquer adhesion and corrosion resistance of the thus treated steel sheet in the above described Examples and Comparative examples were evaluated by the following testing methods after the measurements of the amounts of metallic chromium, metallic nickel and chromium in hydrated oxide by the fluorescent X-ray method, the results of which are shown in the attached Table.

(1) Weldability

The weldability is evaluated by an available range of secondary current in welding as shown in the report by N. T. Williams (Metal Construction, April 1977, page 157–160), that is to say, the wider the secondary current range in welding, the better the weldability. The upper limit in the available secondary current range corresponds to the welding conditions in which some defect such as splashing is found and the lower limit corresponds to the welding conditions in which the breakage occurs in the welded part by tearing tests.

In order to obtain data wherein the available range of secondary current in welding is decided in each sample, large amounts of samples are necessary.

Therefore, the weldability was evaluated by an electric contact resistance according to the following method, because an electric contact resistance has an apparent correlation with an available range of secondary current in welding as shown in the report by T. Fujimura (Journal of The Iron and Steel Institute of Japan, vol. 69, No. 13, Sept. 1983, page 181), that is, the lower the electric contact resistance, the wider the secondary current range in welding. Accordingly, if the electric contact resistance is lower, the weldability is better.

At first, the sample treated on both sides was cut to a size of 20 mm×100 mm after baking at 210° C. for 20 minutes.

The electric contact resistance of the sample was calculated from the change of voltage in a pair of copper disk electrodes (diameter: 65 mm, thickness 2 mm) to which 5 amperes of direct current were supplied and 50 kg of load was added, when two sample pieces were inserted into between a pair of the copper disk electrodes rotating at 5 m/min.

(2) Lacquer adhesion

The sample was baked at 210° C. for 12 minutes after coating with 60 mg/m$^2$ of an epoxy-phenolic type of lacquer. The coated sample was cut into a circular blank having a diameter of 80 mm by a punch press, and the blank was deeply drawn to form a cup.

The lacquer film in the side of a cup was peeled off by an adhesive tape. The adhesion of the lacquer film was divided into 5 ranks, namely, 5 was excellent, 4 was good, 3 was fair, 2 was poor and 1 was bad.

(3) Corrosion resistance after lacquer coating

The sample was baked at 210° C. for 12 minutes after coating with 60 mg/dm$^2$ of an epoxy-phenolic type of lacquer. The coated sample was immersed into the solution containing 1.5% of citric acid and 1.5% of sodium chloride for 7 days at 50° C., after the surface of the coated sample was cross-hatched by a razor.

The corrosion in the scratched part of the coated sample was divided into 5 ranks, namely, 5 was excellent, 4 was good, 3 was fair, 2 was poor and 1 was bad.

TABLE

| | Ex. 1 | Ex. 2 | Ex. 3 | Ex. 4 | Ex. 5 | Ex. 6 | Comp. ex. 1 | Comp. ex. 2 | Comp. ex. 3 |
|---|---|---|---|---|---|---|---|---|---|
| *1Process | A | A | A | B | B | B | — | — | — |
| *2Amount of $CR^0$ (mg/m$^2$) (Bottom layer) | 147 | 124 | 56 | 32 | 295 | 205 | 118 | 0 | 145 |
| *2Amount of $Ni^0$ (mg/m$^2$) (Middle Layer) | 25 | 70 | 20 | 103 | 6 | 56 | 0 | 610 | 26 |
| *2Amount of $Cr^{0\times}$ (mg/m$^2$) (Top Layer) | 8 | 12 | 6 | 4 | 2 | 18 | 15 | 8 | 7 |
| Electric contact resistance (mΩ) | 7 | 13 | 3 | 5 | 10 | 15 | 330 | 82 | 123 |
| Lacquer adhesion | 5 | 5 | 5 | 5 | 5 | 5 | 5 | 5 | 5 |
| Corrosion resistance | 5 | 5 | 4 | 4 | 5 | 5 | 5 | 4 | 4 |

Remarks

*1Process A

Chromium plating → Water rinsing → Nickel plating with the removal of hydrated chromium oxide formed during chromium plating → Water rinsing → Chromate treatment → Water rinsing → Drying Process B Chromium plating → Water rinsing → Cathodic treatment in an acid solution for the removal of hydrated chromium oxide formed during chromium plating → Water rinsing → Nickel plating → Water rinsing → Chromate treatment → Water rinsing → Drying

*2$Cr^0$ shows metallic chromium, $Ni^0$ shows metallic nickel and $Cr^{0\times}$ shows Cr in hydrated chromium oxide.

We claim:

1. A tin-free steel having three layers consisting of a bottom layer of metallic chromium, a middle layer of metallic nickel and a top layer of hydrated chromium oxide on a steel base.

2. A tin free steel according to claim 1, wherein the amount of metallic chromium in said bottom layer is from 30 to 300 mg/m$^2$, the amount of metallic nickel in said middle layer is from 5 to 100 mg/m$^2$ and the amount of hydrated chromium oxide in said top layer is from 2 to 18 mg/m$^2$ as chromium.

3. A tin free steel according to claim 2, wherein the amount of metallic chromium in said bottom layer is from 70 to 150 mg/m$^2$, the amount of metallic nickel in said middle layer is from 15 to 50 mg/m$^2$ and the amount of hydrated chromium oxide in said top layer is from 4 to 12 mg/m$^2$ as chromium.

4. A process for continuously preparing a tin free steel having three layers consisting of a bottom layer of metallic chromium, a middle layer of metallic nickel and a top layer of hydrated chromium oxide on a steel base which comprises:

(a) chromium plating a steel base to form a layer of metallic chromium and hydrated chromium oxide thereon;

(b) a nickel plating the chromium plated steel base with a nickel plating solution under conditions sufficiently acidic to substantially dissolve said hydrated chromium oxide in said solution; and (c) forming a layer of hydrated chromium oxide on the nickel plated, chromium plated steel base of step (b).

5. The process according to claim 4, wherein said nickel plating of the chromium plated steel base with the removal of hydrated chromium oxide formed on the chromium plated steel base is carried out at a temperature of 30°to 70° C. and under a cathodic current density of 2 to 50 A/dm$^2$ in an acidic electrolyte having a pH of 0.5 to 2.0 and containing 5 to 80 g/l of nickel ion.

6. The process according to claim 5, wherein said nickel plating onto the chromium plated steel base with the removal of hydrated chromium oxide formed on the chromium plated steel base is carried out at a temperature of 30° to 50° C. and under cathodic current density of 2 to 30 A/dm$^2$ in an acidic electrolyte having a pH of 0.5 to 1.5 and containing 5 to 80 g/l of nickel ion.

7. The process of claim 4, wherein water rinsing of the plated steel base is performed after step (a) but before step (b) and after step (b) but before step (c).

8. A process for continuously preparing a tin free steel having three layers consisting of a bottom layer of metallic chromium, a middle layer of metallic nickel and a top layer of hydrated chromium oxide on a steel base which comprises:

(a) chromium plating onto a steel base to form a layer of metallic chromium and hydrated chromium oxide thereon;

(b) removing the hydrated chromium oxide formed on the chromium plated steel base by a cathodic treatment in an acidic solution;

(c) nickel plating the chromium plated steel base; and (d) forming a layer of hydrated chromium oxide on the nickel plated chromium plated steel base of step (c).

9. The process according to claim 8, wherein said removal of hydrated chromium oxide formed on the chromium plated steel base is carried out at a temperature of 30° to 70° C. and under a cathodic current density of 2 to 50 A/dm$^2$ and a treating time of 0.5 to 5 seconds in an acidic electrolyte containing at least one acid selected from the group consisting of sulfuric acid, hydrochloric acid, fluoboric acid, fluosilicic acid and hydrofluoric acid having a pH of 0.5 to 2.0.

10. The process according to claim 8, wherein said acidic electrolyte used for the removal of hydrated chromium oxide formed on the chromium plated steel base is the aqueous solution containing at least one compound selected from the group consisting of sulfuric acid and hydrochloric acid.

11. The process according to claim 8, wherein said nickel plating onto the chromium plated steel base is carried out at a temperature of 30° to 70° C. and under a cathodic current density of 2 to 50 A/dm$^2$ in an acidic electrolyte having a pH of 0.5 to 5.5 and containing 5 to 80 g/l of nickel ion.

12. The process of claim 8, wherein water rinsing of the plated steel base is performed after step (a) but before step (b), after step (b) but before step (c) and after step (c) but before step (d).

13. The process according to claim 4 or 8, wherein said chromium plating of the steel base is carried out at a temperature of 30° to 60° C. and under a cathodic current density of 10 to 100 A/dm$^2$ in an electrolyte containing 30 to 300 g/l of chromic acid and at least one additive selected from the group consisting of a fluorine compound and a sulfur compound with the amount of said additive being 1 to 5 weight percent of chromic acid.

14. The process according to claim 13, wherein said fluorine compound is at least one compound selected from the group consisting of hydrofluoric acid, fluoboric acid, fluosilicic acid, ammonium bifluoride, an alkali metal bifluoride, ammonium fluoride, an alkali metal fluoride, ammonium fluoborate, an alkali metal fluoborate, ammonium fluosilicate, an alkali metal fluosilicate and an aluminum fluoride.

15. The process according to claim 13, wherein said sulfur compound is at least one compound selected from the group consisting of sulfuric acid, ammonium sulfate, an alkali metal sulfate, phenolsulfonic acid, ammonium phenosulfonate, an alkali metal phenolsulfonate, phenoldisulfonic acid, ammonium phenoldisulfonate, an alkali metal phenoldisulfonate, ammonium sulfite, an alkali metal sulfite, ammonium thiosulfate, an alkali metal thiosulfate and chromium sulfate.

16. The process according to claim 4 or 8, wherein said hydrated chromium oxide is formed on the nickel plated steel base by a cathodic treatment in an acidic electrolyte containing at least one compound selected from the group consisting of chromic acid, a chromate and a dichromate of an alkali metal, ammonium chromate and ammonium dichromate.

17. The process according to claim 16, wherein said cathodic treatment is carried out at a temperature of 30° to 70° C. and under a cathodic current density of 1 to 20 A/dm$^2$, a quantity of electricity of 1 to 40 coulombs/dm$^2$ in an acidic electrolyte containing 5 to 30 g/l of hexavalent chromium ion.

18. The process according to claim 4 or 8, wherein said hydrated chromium oxide is formed on the nickel plated steel base by a cathodic treatment in an acidic electrolyte containing 10 to 50 g/l of chromic acid and at least one additive selected from the group consisting of a fluorine compound and a sulfur compound wherein the amount of said additive is 0.2 to 1.0 weight percent of chromic acid.

19. The process according to claim 18, wherein said cathodic treatment is carried out at a temperature of 30° to 60° C. and under a cathodic current density of 1 to 10 A/dm$^2$, a quantity of electricity of 1 to 20 coulombs/dm$^2$.

20. The process according to claim 18, wherein said fluorine compound is at least one compound selected from the group consisting of hydrofluoric acid, fluoboric acid, fluosilicic acid, ammonium bifluoride, an alkali metal bifluoride, ammonium fluoride, an alkali metal fluoride, ammonium fluoborate, and an alkali metal fluoborate.

21. The process according to claim 18, wherein said sulfur compound is at least one compound selected from the group consisting of sulfuric acid, ammonium sulfate, an alkali metal sulfate, phenolsulfonic acid, ammonium phenolsulfonate, an alkali metal phenolsulfonate, phenoldisulfonic acid, ammonium phenoldisulfonate, an alkali metal phenoldisulfonate, ammonium sulfite, an alkali metal sulfite, ammonium thiosulfate, an alkali metal thiosulfate and chromium sulfate.

* * * * *